US005596887A

United States Patent [19]

Bergagnini

[11] Patent Number: 5,596,887

[45] Date of Patent: Jan. 28, 1997

[54] RING REMOUNT WRAP ASSEMBLY

[75] Inventor: Norberto Bergagnini, Garden City, N.Y.

[73] Assignee: Sandberg & Sikorski Diamond Corp., New York, N.Y.

[21] Appl. No.: 611,688

[22] Filed: Mar. 6, 1996

[51] Int. Cl.[6] ..... A44C 9/00

[52] U.S. Cl. ..... 63/15.1; 63/15.4

[58] Field of Search ..... 63/15, 15.1, 15.3, 63/15.4, 15.7, 15.6

[56] References Cited

U.S. PATENT DOCUMENTS

D. 348,022 6/1994 Sandberg .
1,724,130 8/1929 Dayton et al. .
2,061,655 11/1936 Granat .
5,253,490 10/1993 Doganay ..... 63/15 X
5,419,158 5/1995 Sandberg et al. .

*Primary Examiner*—Kien T. Nguyen
*Attorney, Agent, or Firm*—Gottlieb, Rackman & Reisman, P.C.

[57] ABSTRACT

A ring remount wrap assembly comprising a pair of wrap members for interlocking connection around a diamond solitaire ring is provided. The wrap assembly includes first and second wrap members each having first elements for receiving a portion of the diamond solitaire therein, and second elements, cooperating with the first elements, for receiving portions of the jewelry stone display of the diamond solitaire. The first and second wrap members cooperatively interlock such that the band of the diamond solitaire is hidden and the diamond of the solitaire protrudes from between the wrap members.

13 Claims, 2 Drawing Sheets

FIG. 3
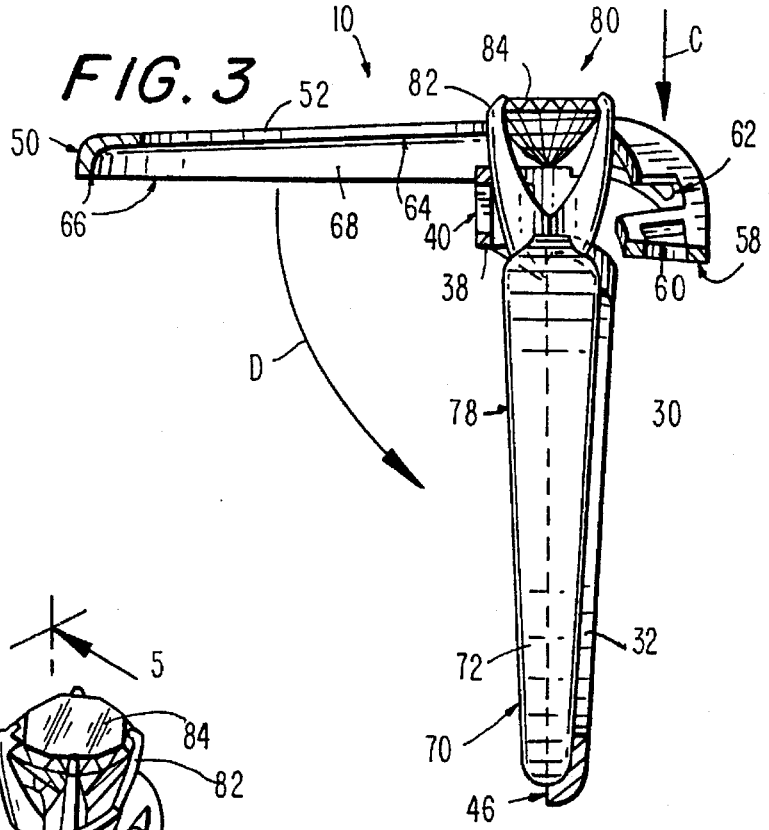
FIG. 4
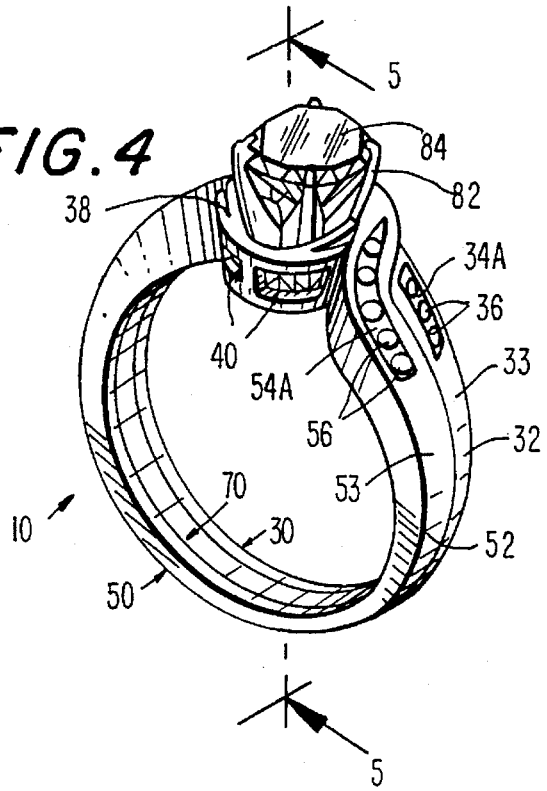
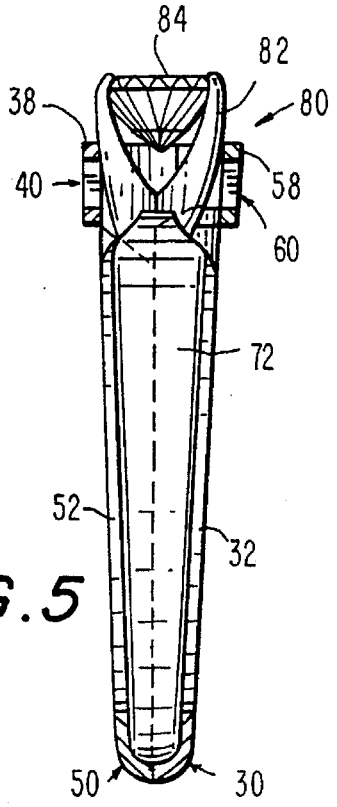
FIG. 5

RING REMOUNT WRAP ASSEMBLY

BACKGROUND OF THE INVENTION

This invention relates to a wrap assembly for a ring, and more particularly, to a ring remount wrap assembly.

Ring wraps (or wrap rings), are one of the best selling rings in the jewelry trade. Wrap rings are very popular because of their versatility when paired with a diamond solitaire. A single wrap ring may be used as a wedding or anniversary band, with engagement ring settings. A wrap ring is particularly desirable because it offers the flexibility of having a new setting, without changing the original ring.

While both single and double wrap rings are very popular, they are usually known to be directed to wraps which use the band of the original ring as part of the finished look of the ring and wrap combination. Specifically, in a standard single wrap configuration, the band of the wrap member sits adjacent to and abutting against the band of the original ring, so that the impression is given of a doubly thick band. Similarly, in the double wrap assembly configurations, the original ring is sandwiched between two wrap members so that all three bands are aligned and the impression of a triple band is given.

A "remount" is usually characterized in the jewelry field as a fashion piece having a bulky band with additional stones set therealong. In the normal course of events, a person owning a diamond solitaire will bring the diamond solitaire to their jeweler, have the diamond removed from its setting and replaced in a more fanciful band having the additional stone settings. Such a new ring is called a remount.

While there are some wrap assemblies which have additional stone settings along their bands, so as to create the impression of a remount when wrapped together with a diamond solitaire, no such wrap assembly achieves the look of a remount because the band of the diamond solitaire is at least somewhat visible; either next to a single wrap member or from between a double wrap assembly.

Accordingly, it would be desirable to overcome the above disadvantages and construct a wrap assembly which is interchangeable with many different diamond solitaires, captures the diamond solitaire in a secure, interlocking structure, and creates the overall impression of a remount.

SUMMARY OF THE INVENTION

Generally speaking, in accordance with the invention, a ring remount wrap assembly comprising a pair of wrap members for interlocking connection around a diamond solitaire ring is provided. The wrap assembly includes first and second wrap members each having first elements for receiving a portion of the diamond solitaire therein, and second elements, cooperating with the first elements, for receiving portions of the jewelry stone display of the diamond solitaire. The first and second wrap members cooperatively interlock such that the band of the diamond solitaire is hidden and the diamond of the diamond solitaire protrudes from between the wrap members.

More particularly, the first elements of each of the wrap members are annular bands, while the second elements of each of the wrap members are curved deformations in the annular bands. Each deformation extends in an axial direction from the plane within which the band lies. The jewelry stone display and the band of the diamond solitaire each have first and second opposite sides, the first sides of each, and the second sides of each being substantially aligned.

When the wrap members of the invention are positioned around the diamond solitaire, the first side of the stone display abuts the deformation of the second wrap member, the second side of the stone display abuts the deformation of the first wrap member, the first side of the ring band abuts the annular band of the first wrap member, and the second side of the ring band abuts the annular band of the second wrap member. In this way, the deformations (second elements) of the wrap members abut opposite sides of the ring then the sides which are abutted by their corresponding and connected annular band. These pieces overlap at the juncture of the annular bands and the deformations, thereby interlocking with each other to secure the diamond solitaire between the wrap members.

Accordingly, it is an object of the invention to provide an improved ring wrap assembly.

Another object of the invention is to provide an improved ring remount wrap assembly.

A further object of the invention is to provide a ring wrap assembly having two cooperatively interlocking wrap members.

Yet another object of the invention is to provide a ring wrap assembly which when applied around a diamond solitaire creates a remount, whereby the band of the diamond solitaire is hidden.

Still other objects and advantages of the invention will in part be obvious and will in part be apparent from the following description.

The invention accordingly comprises the assembly possessing the features, properties and relation of components which will be exemplified in the assembly hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which:

FIG. 3 is a side elevational view, with a cross-sectional view taken along lines 3—3 and 2—2, showing how the second wrap member is positioned to receive the combination of the first wrap member and the diamond solitaire;

FIG. 4 is a perspective view of the ring remount wrap assembly of the invention in its cooperating, interlocking condition, with the diamond solitaire disposed between the wrap members; and FIG. 5 is a cross-sectional view taken along line 5—5 of FIG. 5.

DETAILED DESCRIPTION OF THE PREFERRED EMBODIMENT

Figure 1:
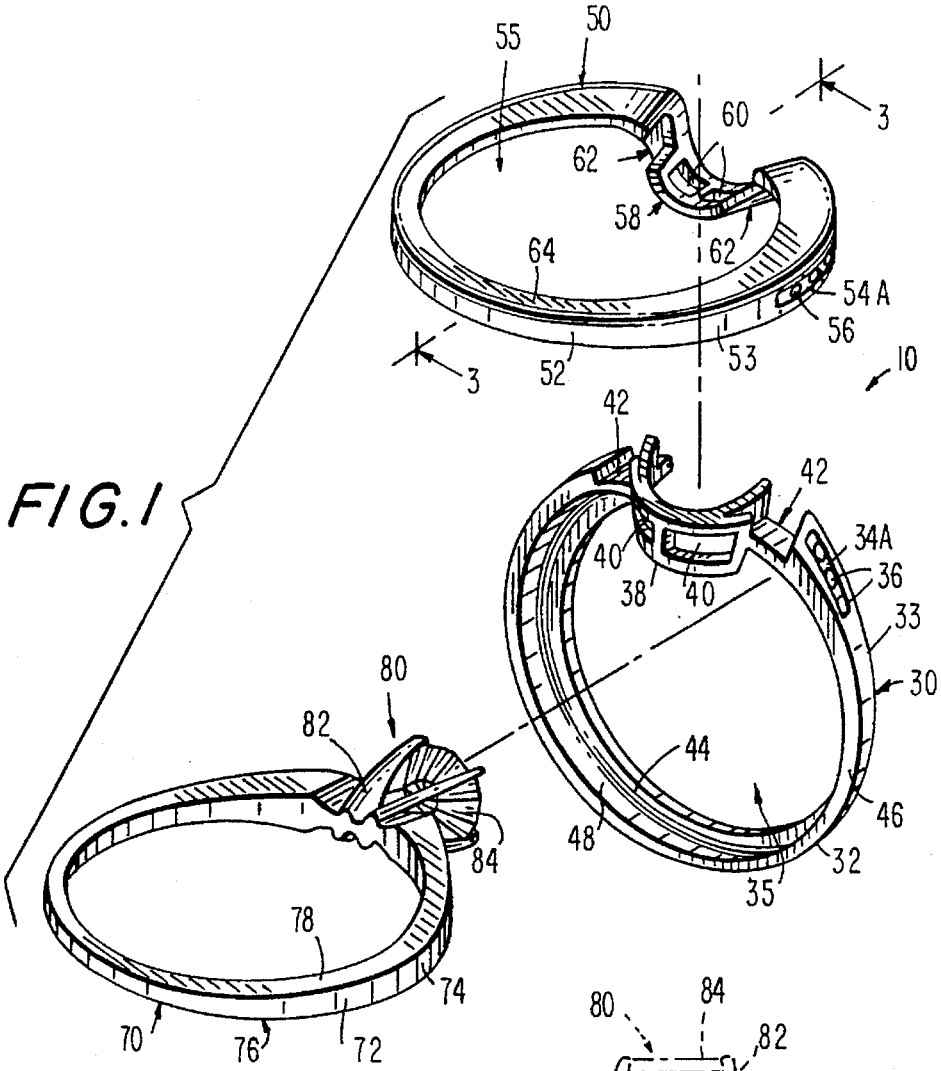
FIG. 1 is an exploded perspective view of each of the wrap members and the diamond solitaire showing the positioning of the pieces prior to interlocking the wrap members around the diamond solitaire.

Referring first to FIGS. 1 and 4, a ring remount wrap assembly made in accordance with the invention and generally indicated at 10 is described. Wrap assembly 10 comprises a first wrap member 30 and a second wrap member 50. First wrap member 30 has a first element, or annular band 32, and a second element, or curved deformation, 38. Second wrap member 50 has a first element, or annular band 52, and a second element, or curved deformation, 58. Wrap members 30 and 50 may be made of gold, silver, platinum or any other type of metal.

Figure 2:
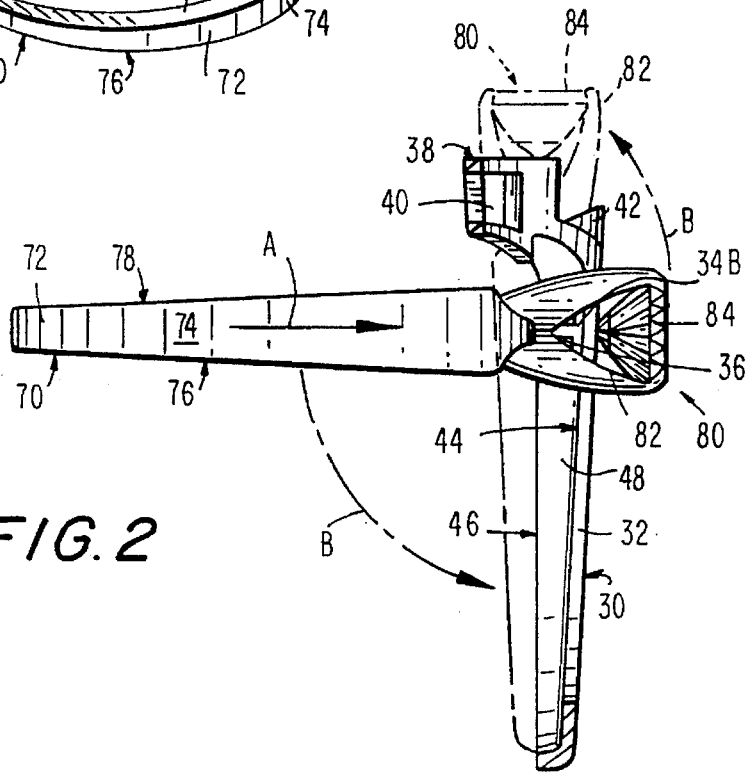
FIG. 2 is a side elevational view, with a cross-sectional view along line 2—2, showing how the diamond solitaire sits within the first wrap member.

As is best seen in FIGS. 1, 2 and 3, curved deformations 38 and 58 complete the closure of annular bands 32 and 52, respectively. The curvature of deformations 38 and 58 extend in a substantially axial direction away from the plane within which annular bands 32 and 52 lie.

Continuing with FIGS. 1 and 4, annular band 32 comprises extending channels 34A and 34B (not shown), formed along at least a portion of the outer surface 33 of annular band 32. Similarly, annular band 52 comprises extending channels 54A and 54B (not shown), formed along at least a portion of the outer surface 53 of annular band 52. Each of channels 34A and B and 54A and B are designed to retain a plurality of stones 36 and 56, respectively, mounted in series within the channels. To accommodate this mounting, channels 34 and 54 have a series of holes (not shown) extending completely through annular bands 32 and 52, for receipt of the stones 36 and 56. As will be discussed in more detail below, and as is best seen in FIG. 4, the "remount" of diamond solitaire 70 is achieved after wrap members 30 and 50 are interlocked around solitaire 70, whereby stones 36 and 56 enhance solitaire 70 with a pleasing, fanciful, and aesthetic appearance. It is to be understood that stones 36 and 56 may be selected from any combination of diamonds, rubies, sapphires, emeralds, or other precious, semi-precious or created stones, as is well known in the art.

Curved deformations 38 and 58 each comprises at least one opening therethrough for allowing light to reflect to and from jewelry stone display 80 of diamond solitaire 70 (to be discussed in further detail below). The openings are best shown in FIGS. 1 and 4, and are generally indicated at 40 for wrap member 30 and at 60 for wrap member 50. These openings may also contain stones (not shown).

Wrap members 30 and 50 are selectively interconnected, and thereby selectively interlocking when mounted, as shown in FIGS. 1–3, and due to notches 42 and 62. Notches 42 are cut into the upper side of annular band 32 immediately proximate to, and on either side of, curved deformation 38. In fact, as is best seen in FIG. 2, notches 42 are really the very beginning and ending of deformation 38, in its continuous extension from annular band 32. Similarly, as is best seen in FIGS. 1, 3 and 4, wrap member 50 has notches 62 located at the beginning and ending of deformation 58, and immediately extending from annular band 52. Notches 62, however, in contrast to notches 42, are cut into the lower surface of band 52. The upper notches 42 of band 32 and the lower notches 62 of band 52, interlock, as best shown in FIG. 4, so that the outer surfaces 33 and 53 of bands 32 and 52 are substantially aligned.

In use, a ring 70, such as a diamond solitaire ring, is mounted between wrap members 30 and 50 of assembly 10, as is best shown in FIGS. 1–4. Ring 70 comprises a ring band 72 and a jewelry stone display 80. Display 80 includes a multi-prong setting 82, as is well known in the art, for retaining a stone 84, such as a solitaire, other type of diamond, or any other stone, including pearls, as is known in the art.

Initially, display 80 of ring 70 is inserted through the opening 35 defined by annular band 32 of wrap member 30, in the direction of arrow A (FIG. 2). Ring 70 is then rotated in the direction of arrows B until ring 70 is in the position shown in phantom in FIG. 2. In this position, band 72 of ring 70 is received against inner surface 48 of band 32 such that first edge 76 of band 72 faces and abuts against lip 44 of band 32, as is best seen in FIG. 2. In this construction, only half of the width of band 70 (see FIG. 3) is received within band 32 of wrap member 30.

Continuing with the placement of ring 70 within wrap member 30 as shown in FIG. 2, once the rotation of ring 70 in the direction of arrows B has been completed, display 80 is approximately halfway received within deformation 38. Significantly, the half of display 80 received within deformation 38 is the opposite side of ring 70 then the side of band 72 received within band 32 of wrap member 30. As will be discussed in more detail immediately below, the halves of display 80 and band 72 of ring 70 which are not received within wrap member 30 will be received within wrap member 50 once the closure of assembly 10 has been completed.

Turning now to FIG. 3, the closure of assembly 10 is completed by the placement of wrap member 50 around ring 70 so that it interconnects with wrap member 30. Specifically, as seen in FIG. 3, wrap member 50 is lowered over display 80 of ring 70, in the direction of arrow C. Display 80 extends partially through opening 55 defined by annular band 52 of wrap member 50 (FIG. 1). Once in this position, wrap member 50 is rotated in the direction of arrow D so that ring 70 is thereafter fully received within assembly 10, as shown in FIG. 4.

Specifically, when rotation of wrap member 50 has been completed in the direction of arrow D of FIG. 3, the portion of band 72 of ring 70 not received within band 32 of wrap member 30 is received against inner surface 68 of band 52 so that edge 78 of ring 70 faces and substantially abuts against lip 64 of band 52. Additionally, the side of display 80 not received within deformation 38, is received within deformation 58 of wrap member 50. Further, notches 42 and 62 interconnect so that wrap members 30 and 50 interlock to hold assembly 10 around ring 70, as best seen in FIG. 4. In its final interlocking position, edge surfaces 46 and 66 of bands 32 and 52, respectively, substantially abut each other so that outside surfaces 33 and 53 now form the new outside surface of the remount shown in FIG. 4.

It will thus be seen that the objects set forth above, among those made apparent in the preceding description, are efficiently attained, and since certain changes may be made in the described assembly and its construction without departing from the spirit and scope of the invention, it is intended that all matter contained in the above description and shown in the drawings, shall be interpreted as illustrative and not in a limiting sense.

It is also to be understood that the following claims are intended to cover all of the generic and specific features of the invention herein described and all statements of the scope of the invention which, as a matter of language, may be said to fall therebetween.

I claim:

1. A wrap assembly for a ring having a band with first and second opposite facing sides and at least one jewelry stone display protruding therefrom, also having first and second opposite sides in substantial alignment with said first and second sides of said ring band, comprising:

a first wrap member comprising an annular band for substantially receiving said ring band, such that said first side of said ring band faces and substantially abuts said annular band of said first wrap member, and a substantially curved deformation in said annular band extending in a substantially axial direction therefrom and cooperating with said annular band for substantially receiving said at least one jewelry stone display such that said second side of said at least one jewelry stone display faces and substantially abuts said first wrap member curved deformation;

a second wrap member comprising an annular band for substantially receiving said ring band such that said second side of said ring band faces and substantially abuts said annular band of said second wrap member, and a substantially curved deformation in said annular band extending in a substantially axial direction therefrom and cooperating with said annular band for substantially receiving said at least one jewelry stone display, such that said first side of said at least one jewelry stone display faces and substantially abuts said second wrap member curved deformation;

wherein said wrap members cooperatively interlock such that said ring band is substantially hidden and said at least one jewelry stone display is disposed between and protrudes from said wrap members;

wherein said axial direction of said deformation of said second wrap member is opposite said axial direction of said deformation of said first wrap member;

wherein said deformations cooperate to define an opening therebetween through which said at least one jewelry stone display protrudes.

2. A wrap assembly as recited in claim 1, further comprising locking means for selectively interlocking said first and second wrap members.

3. A wrap assembly as recited in claim 2, said locking means comprising at least one notch of said annular band of said first wrap member for selective engagement with at least a segment of said annular band of said second wrap member.

4. A wrap assembly as recited in claim 3, wherein said at least one notch comprises a first notch formed on one side of said deformation and a second notch formed on the other side of said deformation.

5. A wrap assembly as recited in claim 3, said locking means further comprising at least one notch of said annular band of said second wrap member cooperating with said at least one notch of said annular band of said first wrap member, such that said first and second wrap members are selectively interlockable around said ring.

6. A wrap assembly as recited in claim 1, wherein each of said first elements of said first and second wrap members has at least one setting and at least one stone retained in said at least one setting wherein the combination of said at least one setting and said at least one stone aesthetically cooperates with said at least one jewelry stone display of said ring.

7. A wrap assembly for a ring having a band and at least one jewelry stone display extending therefrom, comprising:

a first wrap member with a first band for receiving therewithin a first portion of said band of said ring and a first deformation extending from said first band for receiving a portion of said at least one jewelry stone display;

a second wrap member having a second band for receiving therewithin a second portion of said band of said ring, and a second deformation extending from said second band for receiving another portion of said at least one jewelry stone display; and locking means for selectively interconnecting said first and second wrap members such that said first and second bands enclose said ring band such that said ring band is substantially hidden and said at least one jewelry stone display protrudes from between said first and second deformations.

8. A wrap assembly as recited in claim 7, wherein said first and second deformations respectfully extend in a substantially axial direction from said first and second bands.

9. A wrap assembly as recited in claim 8, wherein said axial direction of said deformation of said first band is opposite said axial direction of said deformation of said second band, and wherein said deformations cooperate to define an opening therebetween, through which said at least one jewelry stone display protrudes.

10. A wrap assembly as recited in claim 7, said locking means comprising at least one notch of said first band of said first wrap member in selective engagement with at least a segment of said second band of said second wrap member.

11. A wrap assembly as recited in claim 10, wherein said at least one notch comprises a first notch formed on one side of said deformation of said first wrap member and a second notch formed on the other side of said deformation of said first wrap member.

12. A wrap assembly as recited in claim 10, said locking means further comprising at least one notch of said second band of said second wrap member cooperating with said at least one notch of said first band of said first wrap member such that said first and second wrap members are selectively interconnectable around said ring.

13. A wrap assembly as recited in claim 7, wherein each of said bands of said first and second wrap members has at least one setting and at least one stone retained in said at least one setting, wherein the combination of said at least one setting and said at least one stone aesthetically cooperates with said at least one jewelry stone display of said ring.

* * * * *